US005326140A

United States Patent [19]

Randall

[11] Patent Number: 5,326,140

[45] Date of Patent: Jul. 5, 1994

[54] SUBMERGED CAM ACTUATED ROTARY LATCH FOR FRONT ACCESS PANELS

[75] Inventor: James F. Randall, Fountain Valley, Calif.

[73] Assignee: Northrop Corporation, Los Angeles, Calif.

[21] Appl. No.: 46,824

[22] Filed: Apr. 12, 1993

[51] Int. Cl.[5] ..... E05C 3/06

[52] U.S. Cl. ..... 292/47; 292/229; 292/197

[58] Field of Search ..... 292/47, 48, 49, 50, 292/98, 124, 129, 182, 197, 224, 234, 229, DIG.68

[56] References Cited

U.S. PATENT DOCUMENTS

| | | | |
|---|---|---|---|
| 199,916 | 2/1878 | Lozier . | |
| 324,252 | 8/1885 | Haskins | 292/197 |
| 559,663 | 5/1896 | Bennett . | |
| 634,213 | 10/1899 | Heidt | 292/229 X |
| 1,070,365 | 8/1913 | Voight | 292/47 |
| 1,073,261 | 9/1918 | Mansfield | 292/197 |
| 1,531,487 | 3/1925 | Lundberg | 292/197 |
| 1,603,614 | 10/1926 | Leren | 292/49 X |
| 2,241,336 | 5/1941 | Woodson | 292/229 |
| 2,562,581 | 7/1951 | Schaefer | 292/47 |
| 3,362,573 | 1/1968 | Wales, Jr. | 292/48 X |
| 3,884,056 | 5/1975 | East et al. | 292/197 |
| 5,129,693 | 7/1992 | Schmitt | 292/DIG. 39 X |

FOREIGN PATENT DOCUMENTS

| | | | |
|---|---|---|---|
| 613589 | 11/1948 | United Kingdom | 292/197 |

*Primary Examiner*—Rodney M. Lindsey

*Attorney, Agent, or Firm*—Terry J. Anderson; Robert B. Block; Karl J. Hoch, Jr.

[57] ABSTRACT

A submerged panel latch having an eccentric cam rotatable in the plane of the panel near the panel outer surface and accessible to the user, a latch rotor engaged by the cam and rotatable in a plane perpendicular to that of the cam, inward facing strikers on facing edges of a pair of facing panels, at least one of which is removable at the opposite edge thereof, and concentric openings in said pair of strikers which are concentric and through which said latch rotor is extendable in the closed or locked position of the panels and from which it is withdrawn in the unlocked position.

28 Claims, 3 Drawing Sheets

SUBMERGED CAM ACTUATED ROTARY LATCH FOR FRONT ACCESS PANELS

BACKGROUND OF THE INVENTION

1. Technical Field:

The invention is related to the field of flush panel closure devices and in particular to submerged or flush closure latches or locking devices on flat panel doors for repeated openings and closings with front access only, wherein the closure device does not extend beyond the plane of the panel.

2. Background of the Invention:

The present invention fulfills the need for rapidly and repeatedly opening or unlocking and closing or locking panel doors to cabinets (or, more generally, locking removable portions to base structures) with the constraint that rear access to the cabinet is prohibited. At the same time, the invention fulfills the need for locking devices on panel doors which are flush or submerged with respect to the front plane of the panel door, so as to provide a strong lock which is rapidly unlockable from the front panel surface without any protruding devices at the front panel surface.

Typical locking devices on panels which are adapted for rapid and repeated convenient locking and unlocking of panels or panel doors typically include a rotatable handle which protrudes significantly from the front surface of the panel. This presents a significant problem, particularly in those cases where the panel is the outer or aerodynamic surface of a flight vehicle or aircraft. Such protrusions, even if slight, create non-laminar airflow patterns across the surface, greatly reducing the flight performance characteristics of the flight vehicle.

If the size of the handle is limited or minimized to reduce disturbance in the airflow pattern, then the leverage is reduced and either the locking force must be reduced or the user must exert an inconvenient amount of force to open the panel. If the locking force is reduced, the panel is less securely locked in place. On the other hand, if the user is forced to exert a relatively large force to open or unlock the panel, the rapidity with which the panel may be open and closed is greatly diminished, a significant disadvantage on busy flight lines.

Accordingly, some way of providing a panel lock which is flush (non-protruding) with respect to the panel outer surface, which hold the panel locked closed with a very large force but which is readily opened by a user outside the panel with a minimum application of force is needed.

Various techniques of locking movable members (such as window sashes and doors) with respect to another member (such as a window frame or opposing sash or cabinet) are known in the art. U.S. Pat. Nos. 559,663; 1,073,261 and 324,252 disclose window sash fasteners while U.S. Pat. No. 3,884,056 discloses a sliding door lock. In each of these references, there is a rotatable actuating member controlled by the user and a rotatable locking member actuated by the actuating member, both members rotating along parallel axes. As will be seen below, such arrangements with parallel axes of rotation have nothing to do with the solution to the problem reached by the present invention. This is because such arrangements require rotations perpendicular to the outer surface of the sash or door to be locked or unlocked, which is incompatible with any attempt to minimize protrusions of the locking device beyond the outer panel surface.

U.S. Pat. No. 199,916 and British Patent Document No. 613,589 each disclose devices similar to those discussed above, except that the actuating and locking members rotate about orthogonal axes. However, these two references merely concern braking a window sash against an adjacent surface such as the opposite sash or window frame, and have nothing to do with mechanical locking or interlocking. U.S. Pat. No. 1,531,487 also discloses a locking device in which the actuating and locking members rotate about orthogonal axes. However, this latter reference is directed to a locking device which pinches a lip protruding outwardly from a panel (a casket top). Such outward protrusions are to be avoided at all costs in the present invention.

SUMMARY OF THE INVENTION

The invention is a submerged panel latch having an eccentric cam rotatable in the plane of the panel near the panel outer surface and accessible to the user, a latch rotor engaged by the cam and rotatable in a plane perpendicular to that of the cam, inward facing strikers on facing edges of a pair of adjacent panels, at least one of which is removable at the opposite edge thereof, and concentric openings in said pair of strikers which are concentric and through which said latch rotor is extendable in the closed or locked position of the panels and from which it is withdrawn in the unlocked position.

When the panels are both in the closed position, the latch rotor is pushed through both openings in the strikers by rotating the cam until the point of greatest extent of the cam contacts the latch rotor. Preferably, the latch rotor firmly engages the inner surfaces of both openings in the strikers when locked, so that no movement or vibration of the panels is possible, the rotary latch presenting an irresistible force against relative movement of the two panels.

Unlocking is performed by rotating the cam until the point of minimum extent of the cam contacts the latch rotor. Preferably, withdrawal of the latch rotor from the strikers is assisted by a spring.

The point of maximum extent of the cam includes a circumferential portion thereof of constant radius so that there is no feedback of force to unlock the mechanism. Preferably, a stopper is provided, such as a pin in one striker and a matching slot in the opposite striker, which precisely locates the two panels in the closed position, aligning the openings in the opposing strikers so that the rotary latch is extendable therethrough and preventing over-closing of the panels.

DETAILED DESCRIPTION OF THE PREFERRED EMBODIMENTS

Figure 1:
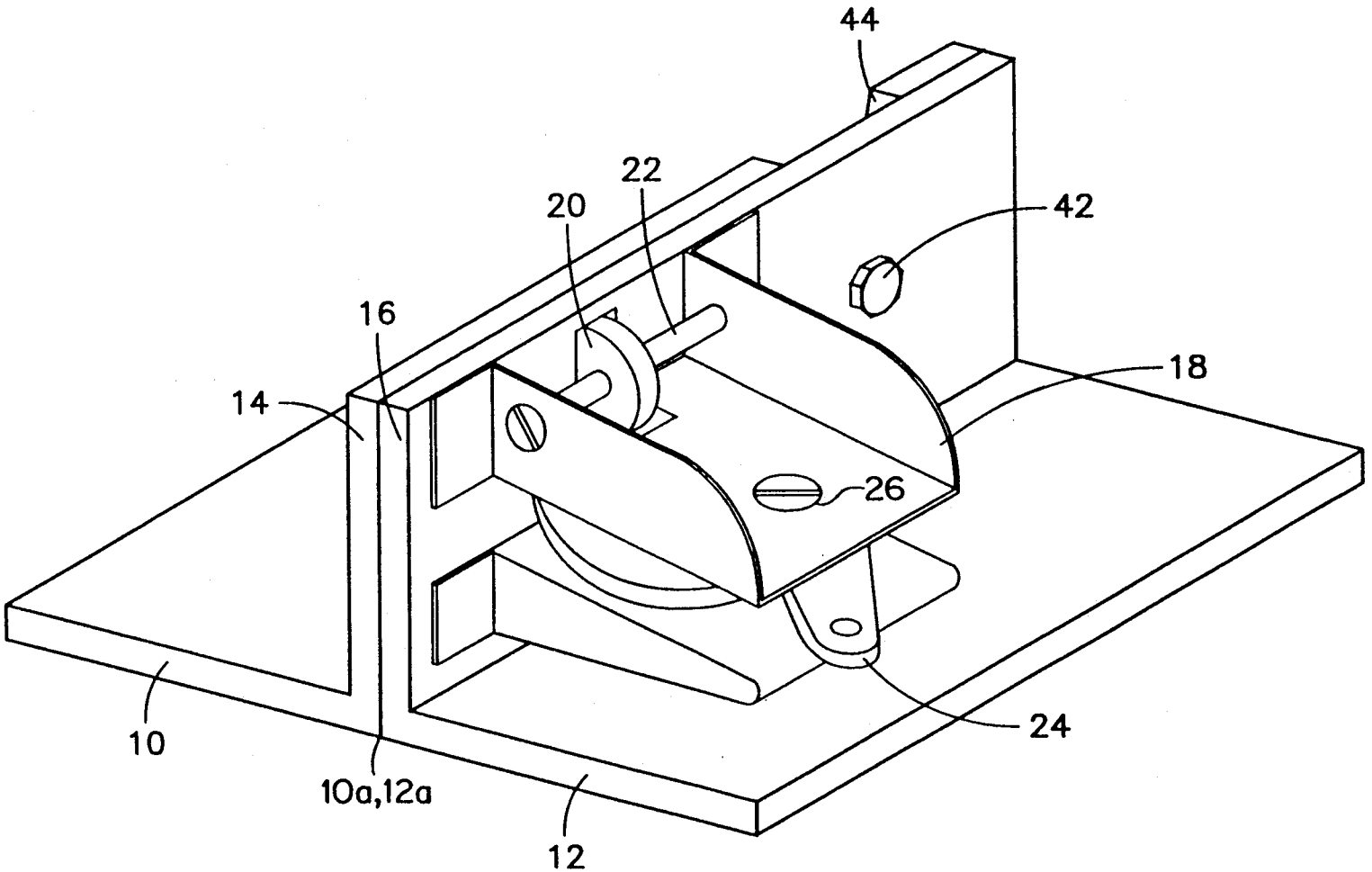
FIG. 1 is a perspective view of a preferred embodiment of the invention.
Figure 2:
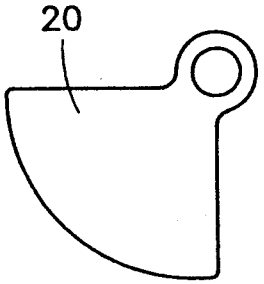
FIG. 2 illustrates the rotary latch employed in the embodiment of FIG. 1.
Figure 3:
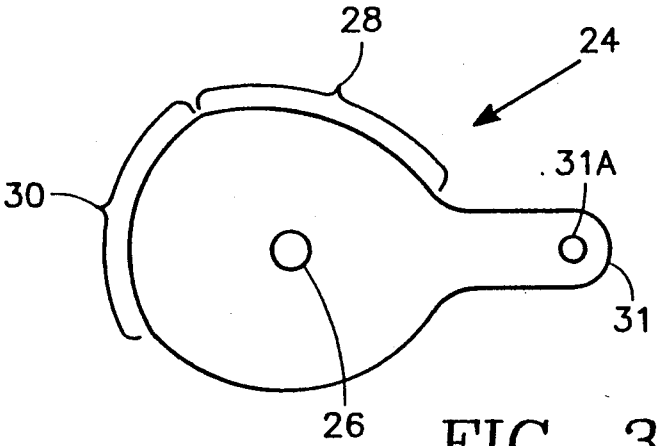
FIG. 3 illustrates the eccentric cam employed in the embodiment of FIG. 1.

Referring to FIG. 1, a pair of facing panels 10, 12, adjoining one another along mutual edges 10*a*, 12*a*, form a portion of an enclosure, such as an aircraft body or cabinet. At least one if not both of the panels 10, 12 is removable from the enclosure or hinged at its opposite edge. Strikers 14, 16 extend inwardly perpendicular from the facing edges 10*a*, 12*a*, respectively. In a preferred embodiment, the panel 12 is not removable, and the striker 16 is a fixed structure. A bracket 18 attached to the interior surfaces of the panel 12 and striker 16 supports a latch rotor 20 (shown in FIG. 2) on a rotor pivot 22 and supports a rotatable eccentric cam 24 (shown in FIG. 3) on a cam pivot 26. Significantly, the cam 24 rotates about the cam pivot 26 in a plane parallel to and near the plane of the panel 12. This permits the cam 24 to be at least slightly recessed relative to the external surface of the panel 12, thus presenting no protrusion therefrom.

Figure 5:
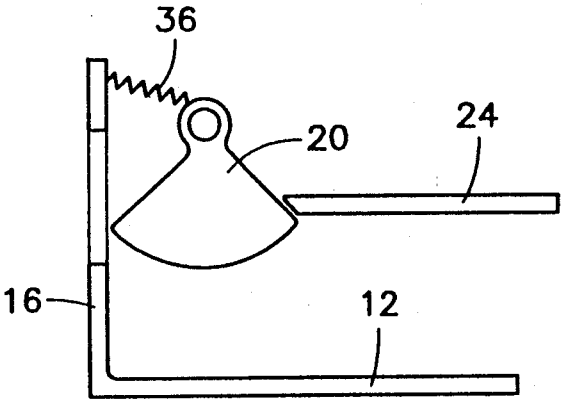
FIG. 5 illustrates the interaction of the cam and latch in the embodiment of FIG. 5 in the open position.
Figure 4:
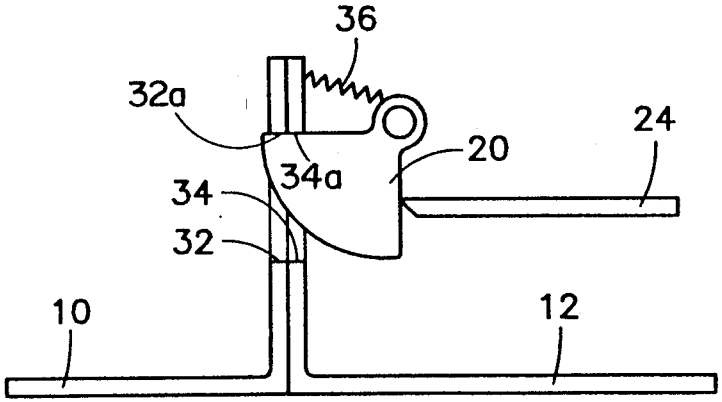
FIG. 4 illustrates the interaction of the cam and latch of the embodiment of FIG. 1 in the closed position.

The cam 24 has a region 28 of a minimum uniform radius and an eccentric region 30 of maximum radius. In order to prevent feedback of force which could inadvertently unlock the latch, the eccentric region 30 has an arc length along the circumference of the cam 24 on the order of roughly 90 degrees. A tab 31 on the cam has a hole 31*a* for engaging a control lever (not shown) or the like, for rotating the cam 24. Referring to FIG. 4, whenever the cam 24 is rotated to a position at which its eccentric region 30 of maximum radius abuts the rotary latch 20, the rotary latch 20 is pushed through openings 32, 34 in the strikers 14, 16 and firmly abuts interior surfaces 32*a*, 34*a* of the openings 32, 34. In this position, the rotary latch presents an irresistible force against relative movement of the panels 10, 12. Referring to FIG. 5, whenever the cam 24 is rotated to a position at which its region 24 of minimum radius faces the rotary latch 20, the rotary latch withdraws from the openings 32, 34 (or at least from the opening 32), preferably with the aid of a spring 36. In this configuration, the panel 10 is free to move relative to the panel 12, and in the illustration of FIG. 5 the panel 10 has been removed.

Figure 6:
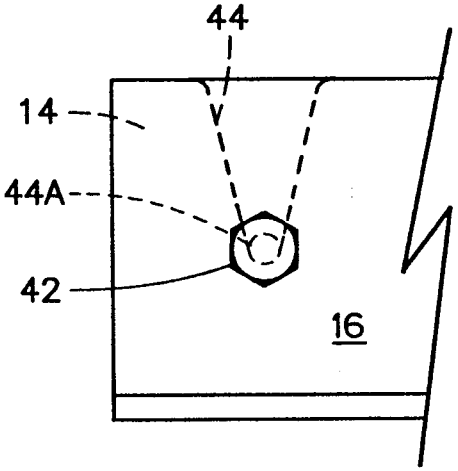
FIG. 6 is a side view of the opposing strikers of the embodiment of FIG. 1 illustrating the pin in one striker and the matching slot in the other striker to align panels in the closed position of FIG. 4.

In order to ensure that the openings 32, 34 are aligned whenever the panels 10, 12 are in the closed position of FIG. 4 so as to permit insertion of the rotary latch therethrough, and in order to prevent over-closure of the panels, a pin 42 (FIG. 6) is provided in the striker 16, the pin 42 extending toward the striker 14. Also, a slot 44 is provided in the striker 14, the pin 42 nesting in the slot 44 and resting against the end 44*a* of the slot 44. The length of the slot 44 determines the position at which the panels close relative to one another, corresponding to alignment of the openings 32, 34.

Figure 8:
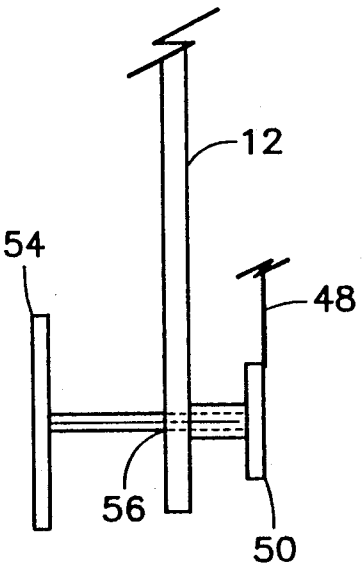
FIG. 8 is a side view of the panel of FIG. 7 illustrating a manual method of controlling a latch.
Figure 7:
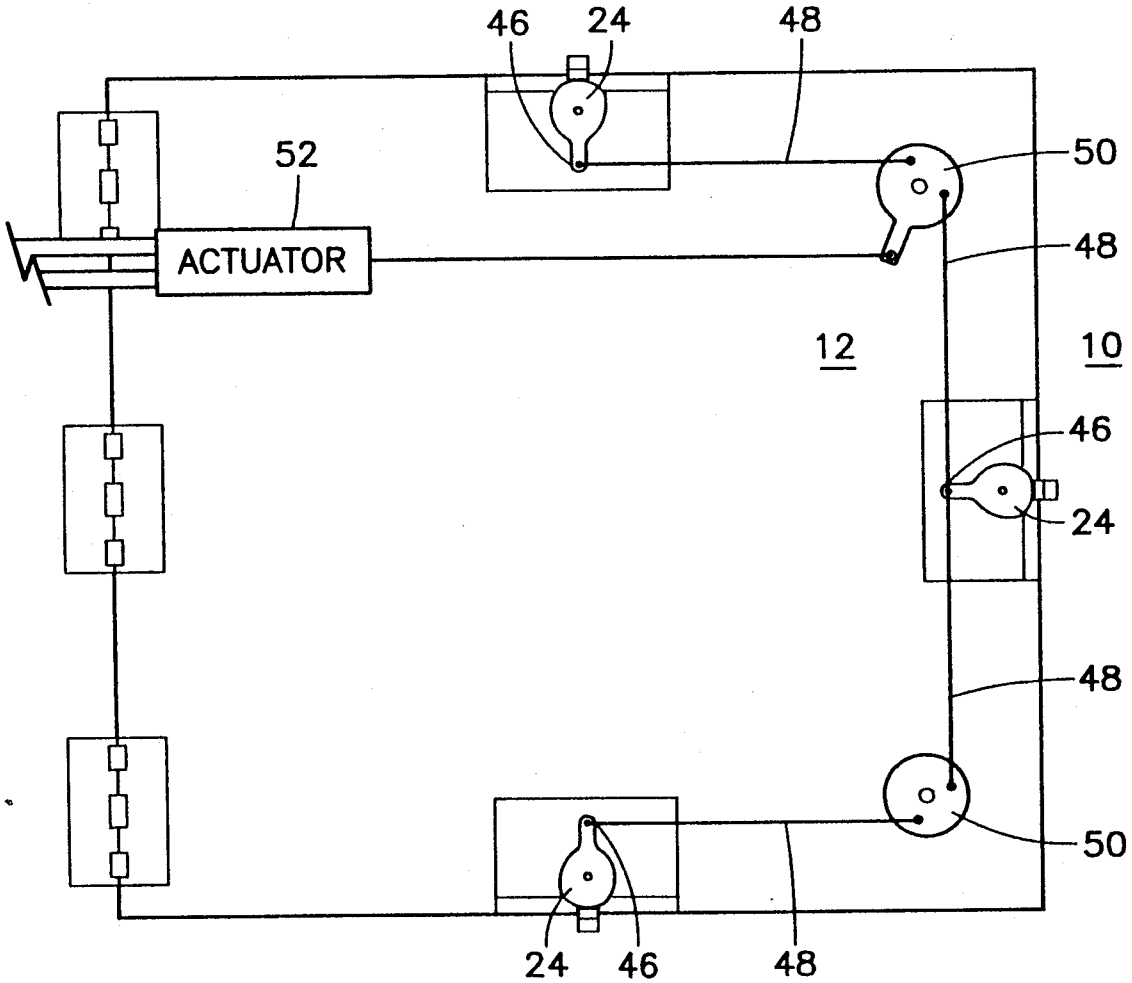
FIG. 7 is an elevational view of a panel with plural latches embodying the invention.

Referring to FIG. 7, the cam or rotor 24 has an arm 46 which can connect to the cams 24 of other similar latches through rods 48 and rotatable idlers 50 to provide single point latching between panels using an actuator 52. Alternatively, manual control can be exercised as shown in FIG. 8 by a hand tool 54 (such as a key) inserted through an external opening in the panel 12 into a slot in one of the idlers 50.

In an alternative embodiment, cam 24 is a sliding cam, rather than a rotating cam. In this alternative embodiment, the cam motion would be from left to right or vice versa in the view of FIGS. 4 and 5. In this configuration, the end of the cam 24 would be linked together with rods to move in unison between closed and open positions (of FIGS. 4 and 5 respectively) when activated from a single point.

The particular embodiment of the invention is not critical, so long as the cam motion is in a plane parallel to that of the panel 12. In the preferred embodiment, this motion is rotation in that plane, while in the alternative embodiment it is translation in that plane.

While the invention has been described in detail with reference to preferred embodiments, it is understood that variations and modifications thereof may be made without departing from the true spirit and scope of the invention.

What is claimed is:

1. A cam actuated rotary latch apparatus for locking a front access panel relative to a panel member adjacent and parallel said front access panel, comprising:

a first striker connected to and extending inwardly from an edge of said front access panel and having a first opening therein;

a second striker connected to said panel member and being parallel to said first striker whenever said front access panel and said panel member are mutually parallel in a closed position, said second striker having a second opening therein which is aligned with said first opening whenever said panel member and said front access panel are in said closed position;

a rotary latch rotatable about a first axis which is fixed relative to said panel member between a locked position in which said rotary latch is at least partly inserted through said first and second openings and an unlocked position in which said rotary latch is withdrawn from at least said first opening; and a cam engaging said rotary latch and having an eccentric region of maximum extent and a normal region of minimum extent, said cam being movable in a plane parallel to a plane of said panel member between a closed position at which said eccentric region abuts said rotary latch inserted through said first and second openings and an open position at which said normal region faces said rotary latch withdrawn from at least said first opening, said cam being located near and submerged relative to said plane of said panel member, whereby user access to said cam without protrusion of said cam beyond an external surface of said panel member is permitted.

2. The apparatus of claim 1 wherein said rotary latch is rotatable in a plane generally perpendicular to the plane in which said cam is movable.

3. The apparatus of claim 1 wherein said panel member is removable and said front access panel is stationary.

4. The apparatus of claim 1 further comprising bracket means attached to said panel member for supporting said rotary latch and said cam, said bracket means including:

a cam pivot having a second axis about which said cam is rotatable; and, a rotor pivot aligned with said first axis about which said rotary latch is rotatable, whereby said first and second axes are fixed relative to said panel member.

5. The apparatus of claim 1 wherein front access panel is removable and said panel member is stationary.

6. The apparatus of claim 1 further comprising spring means for withdrawing said rotary latch from at least said first opening.

7. The apparatus of claim 1 wherein said rotary latch in said locked position firmly abuts an interior surface of said first and second openings whereby relative movement of said front access panel and panel member is prevented.

8. The apparatus of claim 1 further comprising means for stopping relative movement of said front access panel and said panel member toward said closed position at said closed position.

9. The apparatus of claim 8 wherein said means for stopping comprises a pin in one of said strikers facing the other striker and a slot in said other striker in which said pin is nestable, said slot having a termination corresponding to said closed position, whereby said pin abuts said termination upon said front access panel and panel member reaching said closed position.

10. The apparatus of claim 1 wherein said cam is one of:

a rotatable cam, a sliding cam.

11. The apparatus of claim 1 wherein said front access panel is hinged and said panel member is stationary.

12. The apparatus of claim 1 wherein said panel member is hinged and said front access panel is stationary.

13. A cam actuated rotary latch apparatus for locking a front access panel relative to a panel member adjacent and parallel said front access panel, comprising:

(I) plural latch devices disposed at respective locations along a boundary between said panel member and said front access panel, each of said plural latch devices comprising:

(A) a first striker connected to and extending inwardly from an edge of said front access panel and having a first opening therein, (B) a second striker connected to said panel member and being parallel to said first striker whenever said front access panel and said panel member are mutually parallel in a closed position, said second striker having a second opening therein which is aligned with said first opening whenever said panel member and said front access panel are in said closed position, (C) a rotary latch rotatable about a first axis which is fixed relative to said panel member between a locked position in which said rotary latch is at least partly inserted through said first and second openings and an unlocked position in which said rotary latch is withdrawn from at least said first opening, (D) a cam engaging said rotary latch and having an eccentric region of maximum extent and a normal region of minimum extent, said cam being movable in a plane parallel to a plane of said panel member between a closed position at which said eccentric region abuts said rotary latch inserted through said first and second openings and an open position at which said normal region faces said rotary latch withdrawn from at least said first opening;

(II) single point latcher means for actuating all said cams of all of said plural latch devices from a single point.

14. The apparatus of claim 13 wherein said each of said plural latch devices further comprises bracket means attached to said panel member for supporting said rotary latch and said cam, said bracket means including:

a cam pivot having a second axis about which said cam is rotatable; and, a rotor pivot aligned with said first axis about which said rotary latch is rotatable, whereby said first and second axes of said each of said plural latch devices are fixed relative to said panel member.

15. The apparatus of claim 13 wherein said front access panel is removable and said panel member is stationary.

16. The apparatus of claim 13 wherein said each of said plural latch devices further comprises spring means for withdrawing said rotary latch from at least said first opening.

17. The apparatus of claim 13 wherein said rotary latch of said each of said plural latch devices in said locked position firmly abuts an interior surface of said first and second opening, whereby relative movement of said front access panel and panel member is prevented.

18. The apparatus of claim 13 further comprising means for stopping relative movement of said front access panel and said panel member toward said closed position at said closed position.

19. The apparatus of claim 18 wherein said means for stopping comprises:

a pin in a selected one of said first and second strikers of a selected latch device of said plural latch devices; and, a slot in said other striker of said selected latch device in which said pin is nestable, said slot having a termination corresponding to said closed position, said pin abutting said termination upon said front access panel and panel member being in said closed position.

20. The apparatus of claim 13 wherein said cam of said each of said plural latch devices is one of:

a rotatable cam, a sliding cam.

21. The apparatus of claim 13 wherein said rotary latch of said each of said plural latch devices is rotatable in a plane generally perpendicular to the plane in which said cam engaging said rotary latch is movable.

22. The apparatus of claim 13 wherein said cam of said each of said plural latch devices is located near and submerged relative to said plane of said panel member, whereby user access to said cam of said each of said plural latch devices without protrusion of said cam of said each of said plural latch devices beyond an external surface of said panel member is permitted.

23. The apparatus of claim 13 wherein said single point latcher means for actuating all said cams comprises a rotatable idler connected to cams of an associated pair of said plural latch devices adjacent to said idler.

24. The apparatus of claim 23 wherein said single point latcher means for actuating all said cams comprises actuator means connected to said rotatable idler for rotating said idler.

25. The apparatus of claim 13 wherein said single point latcher means for actuating all said cams of all of said plural latch devices comprises:

a plurality of rotatable idlers, each of said plurality of rotatable idlers being connected to cams of respective ones of said plural latch devices adjacent to said each of said plurality of rotatable idlers; and, actuator means connected to a selected rotatable idler of said plurality of rotatable idlers for rotating said selected idler.

26. The apparatus of claim 13 wherein said panel member is removable and said front access panel is stationary.

27. The apparatus of claim 13 wherein said front access panel is hinged and said panel member is stationary.

28. The apparatus of claim 13 wherein said panel member is hinged and said front access panel is stationary.

* * * * *